United States Patent [19]

Kissner

[11] 4,218,600

[45] Aug. 19, 1980

[54] CONNECTING FLEXIBLE SWITCH

[75] Inventor: William R. Kissner, Milwaukee, Wis.

[73] Assignee: W. H. Brady Co., Milwaukee, Wis.

[21] Appl. No.: 919,386

[22] Filed: Jun. 26, 1978

[51] Int. Cl.[2] ..... H01H 3/12; H01H 9/26; H01H 43/08

[52] U.S. Cl. ..... 200/159 B; 200/5 A; 200/46

[58] Field of Search ..... 200/159 B, 262, 265, 200/1 R, 5 R, 5 A, 46

[56] References Cited

U.S. PATENT DOCUMENTS

| | | | |
|---|---|---|---|
| 3,777,222 | 12/1973 | Harris | 200/46 X |
| 3,862,382 | 1/1975 | Glaister et al. | 200/159 B X |
| 3,969,595 | 7/1976 | Johnson | 200/159 B X |
| 4,060,703 | 11/1977 | Everette, Jr. | 200/5 A |

*Primary Examiner*—Steven M. Pollard

[57] ABSTRACT

A flexible switch with a flexible tail bent downward from the switch inside the edge of the switch and placed through an opening in the frame supporting the switch, the tail carrying conductive leads for connecting contacts carried by layers of the switch to external circuitry, thereby allowing for an uninterrupted peripheral adhesive seal between the switch and the underlying frame.

6 Claims, 6 Drawing Figures

CONNECTING FLEXIBLE SWITCH

FIELD OF THE INVENTION

This invention relates to flexible electrical touch switches.

BACKGROUND OF THE INVENTION

In installing a flexible switch on a supporting frame it is necessary to connect the switch leads to other circuitry and desirable to hermetically seal the leads and other circuitry as well as the switch from the environment. Conventionally, switch leads are brought out on a flexible tail to the other circuitry. The tail begins at one edge of the switch and extends outwardly therefrom, and a bezel seal is applied over the entire switch periphery. It would be desirable to effect a peripheral seal without the necessity of placing a bezel or similar protective structure over the periphery of the switch.

Harris U.S. Pat. No. 3,777,222 shows a flexible switch constructed as above described. Two contact-carrying layers each have an integral flexible tail extending horizontally from one edge. The tails carry leads connected to contacts carried by the layers. An insulating adhesive layer bonds the tails together. Outside the switch edge the composite tail is bent downward to connect with an underlying circuit board. A bezel overlies and is sealed to the periphery of the upper surface of the switch.

STATEMENT OF THE INVENTION

I have discovered that a flexible touch switch of simplified construction and improved hermetic sealing can be provided by connecting leads from contacts on layers of the switch to circuitry using a flexible tail bent downward from the switch inward of the panel edge and placed through an opening in an underlying frame supporting the switch, thereby allowing for an uninterrupted peripheral adhesive seal between the switch and the underlying frame through which the bent tail passes. In a preferred embodiment the flexible tail is integral with an upper contact-carrying layer; the tail is bent down through slots in lower layers; and an insert is placed in the void formed where the tail is bent downward, to maintain switch thickness and assure a good hermetic seal in that region.

The invention permits a peripheral seal to be effected without the necessity of adding a bezel seal, and therefore makes possible a flush mount of the switch to the frame, thereby facilitating installation of the switch, improving appearance and durability, and reducing manufacturing costs.

PREFERRED EMBODIMENTS

I turn now to description of presently preferred embodiments of the invention.

STRUCTURE

The drawings show the preferred embodiments, which are then described.

DRAWINGS

For clarity, thicknesses of the various layers are shown greatly exaggerated in size in FIGS. 2 through 6.

DESCRIPTION

Figure 1:
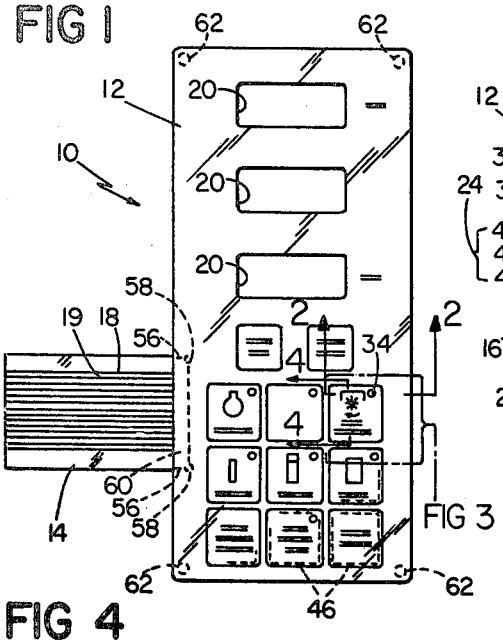
FIG. 1 is a plan view of a preferred embodiment of the invention.
Figure 2:
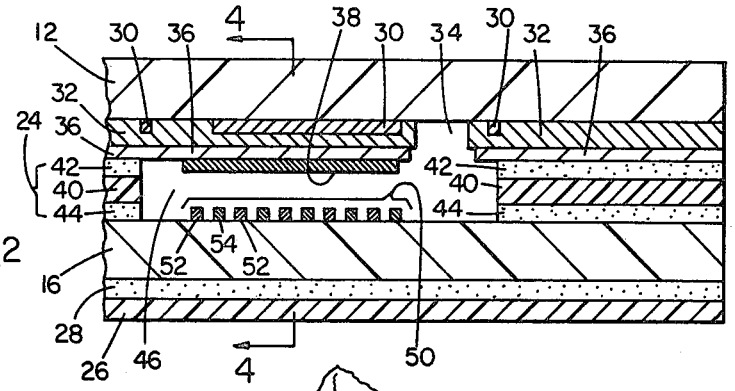
FIG. 2 is a sectional view through 2—2 of FIG. 1.
Figure 3:
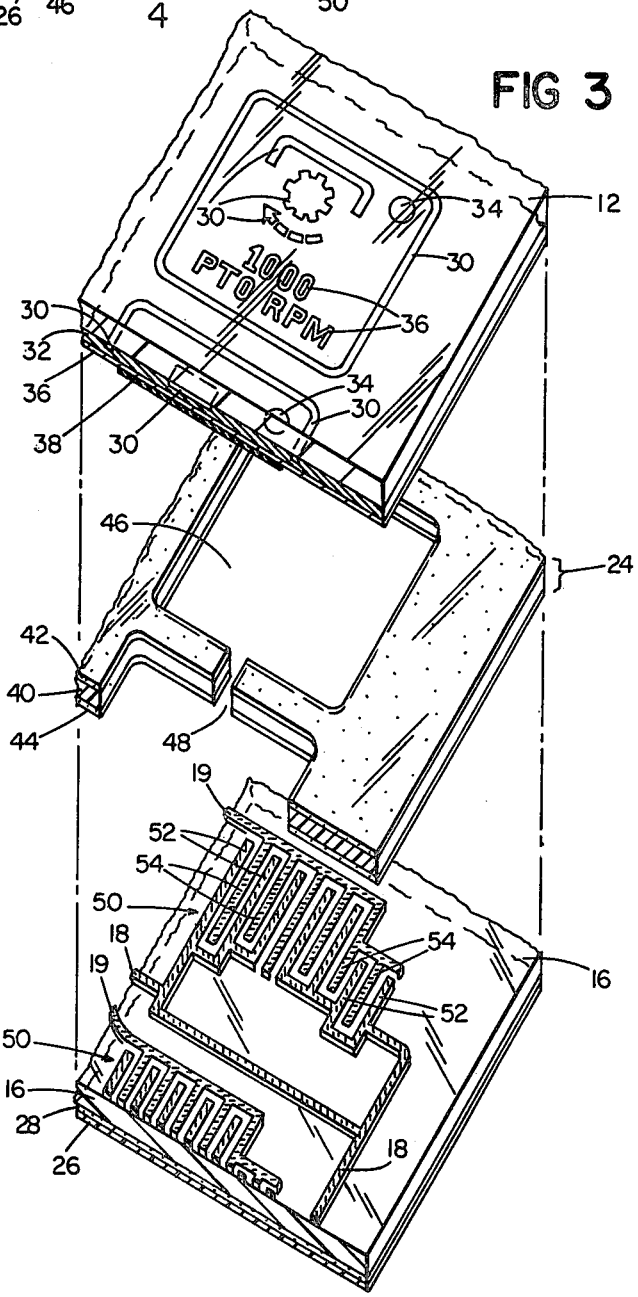
FIG. 3 is an exploded view in perspective of a portion of the embodiment of FIG. 1.

FIG. 1 shows flexible switch panel 10, which is used as a control panel for monitoring the operation of a vehicle. Panel 10 includes transparent overlay 12, on the underside of which are printed white indicia including lettering, symbols, and button outlines, all then underprinted to provide a black background. Extending, in its uninstalled position, from the left side of panel 10 is transparent plastic tail 14, which is an integral extension of transparent substrate layer 16 (FIGS. 2 and 3) spaced below overlay 12. Tail 14 has printed in silver paint on its upper surface conductive leads 18, which lead to conductive switch portions on substrate 16 underneath each of the buttons and which are adapted to be connected at the end of the tail to other circuitry (not shown) on the vehicle. Panel 10 has three apertures 20 for viewing visual data displays when the panel is mounted in the vehicle. Panel 10 comprises a flat composite of several layers as indicated in FIGS. 2 and 3—principally overlay 12, spacer layer 24, and flexible substrate 16. There is also a liner 26 that covers adhesive 28 on the underside of substrate 16 and is removed when panel 10 is to be installed.

Overlay 12, a 10 mil thick flexible non-conductive layer of General Electric Lexan polycarbonate film, of grade 8B05 (which includes a velvet texture) and color ·112, carries on its lower surface, first, a series of graphic inks with respect to which the overlay is transparent and, second, under the inks, pads of conductive paint. There are three layers of graphic ink, all of which are acrylic-based System II inks obtained from KC Coatings, Incorporated, Kansas City, Mo., and all of which are applied by screening. First applied is layer 30 of opaque white ink to form the symbols, certain of the words that are not to be backlighted, and the button outlines. Next applied is layer 32 of black ink for the panel's background color. The black ink is applied everywhere except for spaces that are left for words that are to be backlighted, such as the letters (indicia) in FIG. 3, and except for holes 34, which are left to allow red switch activation lights (not shown) underneath the panel when mounted on a vehicle to shine through to indicate when a particular button has been pushed (where uncoated with ink, overlay 12 is translucent to such lights; substrate 16 and adhesive 28 are transparent). Finally, layer 36 of translucent white ink is applied over the whole underside of overlay 12 except for holes 34 and zones defined by a small square around each hole providing an area larger than the hole, for a safety factor against paint going in it. Translucent white 36 fills in the spaces left untouched by the black ink (FIG. 4) to form indicia that can be backlighted by green light sources (not shown ) underneath the panel when it is mounted on a vehicle. Each layer of ink is about 0.4 mil thick (thicker where it fills in spaces left unfilled within a preceding layer), with a total thickness for the three layers of about 1.2 mils.

Applied on translucent white layer 36 are separate pads 38 of conductive paint, each pad being about 0.4 mil thick and mostly about $\frac{5}{8}''$ or $\frac{7}{8}'' \times \frac{7}{8}''$ in area, and located underneath a particular button outline. The paint is silver paint sold by Acheson Colloids of Port Huron, Michigan, under the designation Electrodag 415SS.

Spacing overlay 12 from substrate 16 is spacer layer 24, which is a Mylar (DuPont trademark) transparent polyester layer 40 having on both its surfaces a thermoset (after it is in place) acrylic transparent pressure-sensitive adhesive. Upper adhesive layer 42 is 1.5 mils thick, as is lower adhesive layer 44. Mylar layer 40 is 3 mils thick. The adhesive layers serve to bond the Mylar to overlay 12 and to substrate 16. An adhesive suitable for use in layers 42 and 44 is the 3M Company's 467 Firm Acrylic Pressure Sensitive Adhesive. Spacer layer 24 is diecut to provide contact openings (FIG. 3) underneath each button outline. Channels 48 are provided in spacer layer 24 between those contact openings 46 that are adjacent along the longitudinal dimension of panel 10. These channels serve to equalize air pressure in the longitudinally aligned openings; panel 10 overall is hermetically sealed.

Substrate 16 is a 5 mil thick flexible insulating layer of Mylar (DuPont trademark) transparent polyester film. Deposited on its upper surface are conductive paint switch areas 50 under each of the contact openings 46. Each pattern 50 includes interfitting spaced-apart groups of fingers (about 1/16" wide and ½" long) 52 and 54. Each group of fingers is electrically isolated from the other. The fingers in each group are all joined to separate conductive leads 18, 19 that continue out along tail 14. Connection of any two adjacent fingers, one from each group, by pad 38, which acts as a shorting bar, closes the circuit between conductive leads 18, 19 leading from each group of fingers. The paint used for the fingers 52, 54 and leads 18 is the same as that used for pads 38 and is also 0.4 mil thick.

Underneath substrate 16 is another layer of adhesive 28, the same transparent adhesive as that used in layers 42 and 44. Transparent Mylar liner 26 covers adhesive 28 until panel 10 is ready for mounting. Adhesive layer 28 and liner 26 are each about 2 mils thick.

Figure 4:
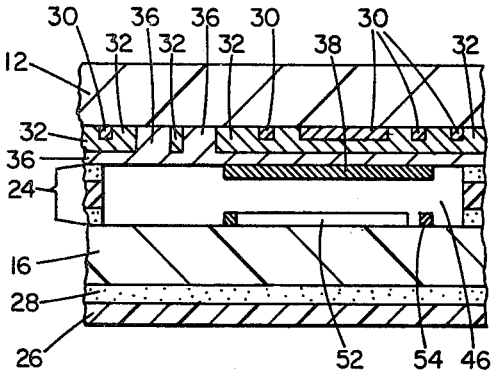
FIG. 4 is a sectional view through 4—4 of FIG. 1.

As shown in FIG. 4, opening 46 in spacer layer 24 is wider than pad 38 (as it is in the coplanar transverse direction not shown), leaving an open space under the lettering (FIG. 3) formed by translucent white layer 36 for backlighting of the lettering, which is provided by a green light (not shown) under adhesive layer 28 when it is mounted on a vehicle. The light can shine up through adhesive 28, substrate 16, translucent white lettering 36, and substrate 12.

Figure 5:
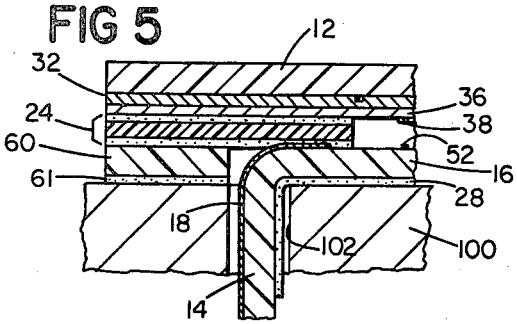
FIG. 5 is a sectional view through FIG. 1 near the centerline of the tail, showing a small portion of the embodiment of FIG. 1 installed on a vehicle frame.

As shown in FIG. 5, in mounting panel 10 to vehicle frame 100, liner 26 is removed, and tail 14 is bent perpendicularly down from the panel, inserted through slot 102 in the vehicle frame, and connected to vehicle circuitry (not shown). Two cuts 56 (FIG. 1) each about ¼ inch long in substrate 16 are made under spacer layer 24 and overlay 12 directly inward from tail 14, and at the end of each cut a small circular portion 58 of substrate 16 is removed to allow bending down of the tail inward of the panel edge without tearing substrate 16. Mylar insert 60 with a bottom adhesive layer 61 (same transparent adhesive as used in layers 42 and 44) fills the void left by bent tail 14. Bending tail 14 down inward of the panel edge permits panel 10 to be sealed to vehicle frame 100 around the panel's entire periphery, because adhesive 28 will seal the panel to vehicle frame 100 everywhere except the space between where the tail bends and the adjacent panel edge and there adhesive 61 and insert 60 will complete the seal. Liner 26 and adhesive 28 stop at the panel edge.

Holes 62 formed through spacer layer 24, substrate 16, adhesive layer 28, and liner 26 help to register these parts during assembly of panel 10.

Figure 6:
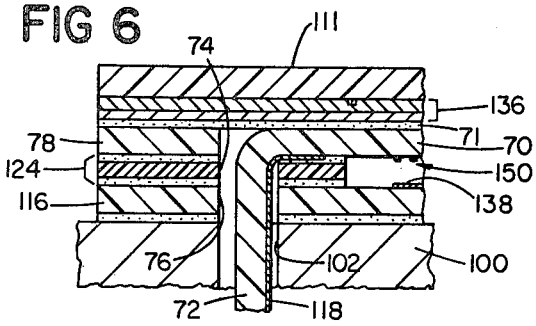
FIG. 6 is a sectional view showing the same portion as in FIG. 5 for the most preferred embodiment.

Turning to FIG. 6, there is shown a sectional view of the most preferred embodiment of the invention. Additional upper 5 mil polyester contact-carrying layer 70 and two mil adhesive layer 71 are added just below graphic ink layers 136, and conductive ink pads 138 and patterns 150 are inverted in relation to their locations in the first embodiment. Upper layer 70 carries patterns 150 and conductive leads 118 that continue out along tail 72, an integral extension of layer 70. Substrate 116 carries conductive pads 138. Spacer layer 124 separates layers 70, 78 and 116. Slots 74, 76 are provided in spacer layer 124 and substrate 116 to receive bent tail 72, the slots being just long enough to accommodate the tail width. Insert 78 is placed on top of spacer layer 124 during manufacturing prior to application of underprinted overlayer 111 and fills the void left by bent tail 72. No equivalents to circular portions 58 (FIG. 1) are required in this embodiment.

OPERATION

In the embodiment of FIG. 1 a person selects the desired button (backlighting of certain of the lettering permits it to be read in the dark) and presses it with his finger generally in the center of the button outline. This action causes overlay 12 to be depressed, causing pad 38 to contact and bridge at least some fingers 52 and 54. This completes a circuit and activates a red light under the hole 34 of the particular button pushed to indicate to the operator that he has completed the desired circuit. When pressure from the finger is removed, overlay 12 because of the memory of the polycarbonate, will return to its original position, reopening the circuit.

The embodiment of FIG. 6 has the same mode of operation.

OTHER EMBODIMENTS

Instead of acting merely as shorting bars, conductive pads 38 could be connected to external circuitry. This requires conductive leads emanating from both upper and lower layers, and can be implemented by using two flexible tails. One such embodiment combines the tail structures of FIGS. 5 and 6; parallel tails extend from each layer, and are joined by an intermediate adhesive layer. A second two tail embodiment combines the tail shown in FIG. 5 with a second flexible tail integral with an extension of the upper layer first folded underneath the spacer layer so as to be coplanar with the lower layer and then bent downward adjacent to the first tail. The two tails can then be joined with insulating adhesive.

An even more preferred structure than use of two tails for electrically connecting to both upper and lower layers is to use one tail extending from one of the layers and to connect the leads of the other layer to leads on the tail layer by means of conductive epoxy deposited between conductive ink pads on the top and bottom layers through holes made in the spacer layer. Such a construction is illustrated in the copending U.S. Pat. application of Wayne K. Parkinson entitled "Backlighting Flexible Switch".

OTHER INVENTIONS

The arrangement embodied in the structure shown in FIG. 6 of a downwardly bent tail integral with an upper layer and extending through slots in lower layers was the invention of Wayne K. Parkinson.

What is claimed is:

1. A flexible switch for mounting on an underlying frame, comprising:

one or more flexible plastic layers, one said layer carrying on one surface a first contact portion and a first conductive lead, means for spacing said contact-carrying layer from a facing surface carrying a second contact portion aligned with said first contact portion so that said first and second contact portions are electrically isolated in the absence of an external compressive force tending to bring said layer into contact with said facing surface, a flexible plastic tail integral with one said flexible layer, said tail being bent downward from said layer at a bend region spaced inward from the edge of said switch and said tail carrying on one surface a second conductive lead integral with a conductive lead on said integral layer for electrically connecting said first conductive lead to external circuitry, and an insert means for occupying at least a portion of the zone from which said tail is bent downward, said zone being that region adjacent to said integral flexible layer occupied by said tail in its unbent condition, whereby said first contact portion can be electrically connected to external circuitry by means of the electrical path formed by said first and second leads and an uninterrupted peripheral seal can be made between the lower surface of said flexible layer and said underlying frame, with said flexible tail extending through a slot in said frame.

2. A flexible switch for mounting on an underlying frame comprising:

a flexible plastic layer carrying on one surface a first contact portion and a first conductive lead, means for spacing said flexible layer from a facing surface carrying a second contact portion aligned with said first contact portion so that said first and second contact portions are electrically isolated in the absence of an external compressive force tending to bring said layer into contact with said facing surface, and a flexible tail secured at its upper end to said flexible layer, bent downward from said layer inward from the edge of said layer, and carrying on one surface a second conductive lead electrically connected to said first conductive lead and to external circuitry, said flexible tail being integral with said flexible layer and defined at its inner end by two inward cuts made from one edge of said layer, and said first and second leads being one continuous lead following a path leading from said first contact portion onto that portion of said flexible layer which is cut to form said tail, whereby said first contact portion can be electrically connected to external circuitry by means of the electrical path formed by said first and second leads and an uninterrupted peripheral seal can be made between the lower surface of said flexible layer and said underlying frame, with said flexible tail extending through a slot in said frame.

3. The flexible switch of claim 2 further comprising an insert occupying the void formed where said tail is bent downward, said void being the planar zone bordered by the edge of said flexible layer, said two inward cuts, and the junction of said tail and said layer.

4. The flexible switch of claim 3 wherein said flexible layer and said insert each carries an adhesive layer on one side thereof, said adhesive layer on said insert substituting for that portion of the adhesive layer on said flexible layer removed with said tail.

5. The flexible switch of claim 2 wherein substantially circular portions of said flexible layer are removed at the inward ends of said cuts, thereby preventing tearing of said layer.

6. The flexible switch of claim 1 wherein said integral flexible layer is the lowermost contact-carrying layer of said flexible switch, and said first contact portion is on the upper surface of said layer.

* * * * *